US006935496B2

(12) United States Patent
Chang et al.

(10) Patent No.: US 6,935,496 B2
(45) Date of Patent: Aug. 30, 2005

(54) GOLF BAGS IN SEMI-KNOCKED DOWN KIT FORMS, GOLF BAGS ASSEMBLED FROM SUCH KITS AND AN IMPROVED METHOD OF ASSEMBLING GOLF BAGS

(75) Inventors: I-Teh Chang, Flat B, 12/Fl., Tower 2, Island Harbourview, 11 Hoi Fai Road, Kowloon, Hong Kong SAR (CN); Mike Batten, HKSAR (CN)

(73) Assignee: I-Teh Chang, Kowloon (CN)

( * ) Notice: Subject to any disclaimer, the term of this patent is extended or adjusted under 35 U.S.C. 154(b) by 0 days.

(21) Appl. No.: 10/225,166

(22) Filed: Aug. 22, 2002

(65) Prior Publication Data

US 2004/0035729 A1 Feb. 26, 2004

(51) Int. Cl.[7] ..... A63B 55/00; A63B 55/04; A63B 55/06

(52) U.S. Cl. ..... 206/315.6; 206/315.3; 206/315.8; 206/577

(58) Field of Search ..... 206/315.3, 315.6, 206/315.8, 577; 29/452, 469; 211/70.2

(56) References Cited

U.S. PATENT DOCUMENTS

| | | | | | |
|---|---|---|---|---|---|
| 1,092,729 | A | * | 4/1914 | Low et al. | 206/315.5 |
| 1,227,657 | A | * | 5/1917 | Pierce | 206/315.6 |
| 1,271,784 | A | * | 7/1918 | Simpson | 206/315.6 |
| 1,798,638 | A | * | 3/1931 | Stone et al. | 206/315.6 |
| 2,256,521 | A | * | 9/1941 | Kirkpatrick et al. | 206/315.3 |
| 2,781,072 | A | * | 2/1957 | Kouke | 206/315.6 |
| 2,860,679 | A | * | 11/1958 | Kouke | 211/70.2 |
| 2,866,490 | A | * | 12/1958 | Thompson | 206/315.4 |
| 3,710,901 | A | * | 1/1973 | Guard et al. | 190/107 |
| 4,181,167 | A | * | 1/1980 | Ret | 206/315.6 |
| 4,249,586 | A | * | 2/1981 | Setani | 206/315.4 |
| 4,319,616 | A | * | 3/1982 | Light | 206/315.2 |
| 4,378,039 | A | | 3/1983 | Suk | |
| 4,506,854 | A | | 3/1985 | Kim | |
| 4,691,823 | A | * | 9/1987 | Pape | 206/315.6 |
| 4,753,344 | A | | 6/1988 | Antonious | |
| 4,768,650 | A | * | 9/1988 | Chancellor, Jr. | 206/315.3 |
| 4,895,230 | A | | 1/1990 | King | |
| 5,029,703 | A | * | 7/1991 | Dulyea, Sr. | 206/315.3 |
| 5,188,243 | A | * | 2/1993 | Ruiz | 211/70.2 |
| 5,447,228 | A | * | 9/1995 | Hodgson, III | 206/315.3 |
| 5,482,160 | A | * | 1/1996 | Perrin | 206/315.8 |
| 5,505,300 | A | * | 4/1996 | Joh | 206/315.6 |
| 5,528,813 | A | * | 6/1996 | Biafore, Jr. | 29/452 |
| 5,638,954 | A | | 6/1997 | Hsien | |
| 5,769,220 | A | * | 6/1998 | Hong | 206/315.3 |
| 5,788,071 | A | | 8/1998 | Shiao | |
| 5,845,773 | A | * | 12/1998 | Kim | 206/315.6 |
| 5,899,328 | A | * | 5/1999 | Dulyea, Sr. | 206/315.3 |
| 5,918,737 | A | * | 7/1999 | Kwon | 206/315.3 |
| 5,941,383 | A | | 8/1999 | Cheng | |
| 5,984,095 | A | * | 11/1999 | Kim | 206/315.6 |
| 6,047,822 | A | * | 4/2000 | Batten | 206/315.6 |
| 6,415,919 | B1 | | 7/2002 | Keller | |
| 6,598,743 | B1 | * | 7/2003 | Puskaric | 206/315.6 |

* cited by examiner

*Primary Examiner*—Sue A. Weaver
(74) *Attorney, Agent, or Firm*—Burns, Doane, Swecker & Mathis, L.L.P.

(57) ABSTRACT

A golf bag which can be easily assembled including a top collar member, a molded bottom end member, a flexible body interconnecting the top collar member and the bottom end member, a partitioning member and stays interconnecting the partitioning member and the bottom end member. The top collar member includes a border portion defining an aperture for receiving golf clubs, the partitioning member includes a substantially rigid grid structure for dividing the aperture into a plurality of sections, the partitioning member includes fasteners for engagement with corresponding fasteners on the top collar member, the partitioning member and the bottom end member include corresponding retention devices for receiving the stays.

22 Claims, 13 Drawing Sheets

STAYS

GOLF BAGS IN SEMI-KNOCKED DOWN KIT FORMS, GOLF BAGS ASSEMBLED FROM SUCH KITS AND AN IMPROVED METHOD OF ASSEMBLING GOLF BAGS

FIELD OF INVENTION

The present invention relates to bags with an elongated flexible body supported by longitudinally extending stays, such as golf bags, and more particularly, to golf bags in semi-knocked down kit forms, to a method of assembling golf bags from semi-knocked down kits and to golf bags assembled from such semi-knocked down kit forms. More specifically, although of course not solely limiting thereto, this invention relates to golf bags assembled from a first and second sub-assemblies which can be snap-fitted together to form a complete golf bag.

BACKGROUND OF THE INVENTION

Golf is a very popular outdoor sporting game which is played on a golf course. In playing a golf game, different golf clubs, for example, woods, irons and putters, are usually required to impart an optimal drive to the ball and to hit the golf ball towards and into a hole during the various phases of a golf game.

Golf clubs are usually kept together in a golf bag for easy storage and convenient transportation to and from golf courses and between holes. Golf bags are usually designed to allow easy and quick retrieval of the various clubs during a game. A typical golf bag is an elongate bag with a rigid moulded top collar and a closed moulded bottom member at its longitudinal ends together with a circumferential enclosure extending between the top collar and the bottom member. The top collar is usually supported from the bottom member by a plurality of rigid stays which are usually distributed around the edge of the bottom member and which are typically rigid plastic posts extending between the top collar and the bottom member.

Golf clubs are usually stored in a golf bag with the club heads protruding above a cushioned partitioning member formed on the top collar and with the handles resting on the upper surface of the bottom member. As the bottom member has to bear almost all the weight of golf clubs, it must be reasonably strong and is usually a moulded piece made of hard plastics. To avoid the handles from rocking about in the bottom of a golf bag during transportation or from entangling with each other which may cause damage, breakage or undesirable scratches, good golf bags are always formed with a number of small compartments which are small enough to limit excessive and undesirable movement of the clubs.

The compartments are generally formed by flexible partitioning or dividing straps which are taut and which extend between the moulded top collar member and the moulded bottom member of a golf bag. To provide for a framework of compartments, a rigid partitioning member forming a grid of rigid ridges which defines the peripheral walls of the compartments is usually formed across the aperture defined by the top collar member. The flexible straps are usually made, for example, of fabric. Nylon or polyester are preferred because they are light and friendly to the shafts of golf clubs.

Golf bags are usually transported in their complete or finished form from manufacturers to distributors and then to the end users or consumers. As a typical golf bag generally includes a hollow and substantially cylindrical body with the top collar member defining the general cross section with the longitudinal length approximately equal to the length of the golf clubs, golf bags are generally very bulky and are relatively expensive to transport, even though they are not particularly heavy. The high transportation costs are particularly noticeable when finished golf bags are transported by containers, courier, air freight in which case the transportation costs are generally proportional to the volume of the goods being delivered.

Furthermore, golfers or golf bag users generally find it very inconvenient when they have to transport golf bags from one place to another, for example, between home and golf courses, because of the bulkiness of the golf bag. As a result, when a few golfers are travelling together on road for golf playing, cars with relatively a large storage space must be selected to accommodate the golf bags.

Hence, it will be desirable if golf bags can be made into kit forms, such as semi-knocked down kit forms, which can be easily assembled without undue complexities and the need of specific tools. To facilitate easy transportation and handling by users, it will be highly desirable if there can be provided golf bags which can be collapsed and re-assembled without unduly complicated efforts and tools.

OBJECT OF THE INVENTION

Accordingly, it is an object of the present invention to provide golf bags in semi-knocked down kit forms which can be assembled without undue difficulty and without specific tools. It is also an object of the present invention to provide golf bags which are easily collapsible and can be easily assembled and reassembled to facilitate easy and convenient transportation. Of course, it is desirable that golf bags fulfilling the aforesaid objective should retain the general robustness characteristic of presently available golf bags. Accordingly, it is also an object of the present invention to provide methods of collapsing assembling and reassembling golf bags of the aforesaid description.

SUMMARY OF THE INVENTION

Accordingly, there is provided a golf bag including a top end member, a bottom end member, a flexible body interconnecting said top collar member and said bottom end member, a partitioning member and a plurality of stays interconnecting said partitioning member and said bottom end member, said top end member includes a top collar member and a partitioning member, said top collar member includes a border portion defining an aperture for receiving golf clubs, said partitioning member includes a substantially rigid grid structure for dividing said aperture into a plurality of sections, said partitioning member includes fastening means for engagement with corresponding fastening means on said top collar member, said top end member and said bottom end member include corresponding retention means for receiving said stays.

According to a second aspect of the present invention, there is provided a golf bag including a top collar member, a bottom end member, a flexible body interconnecting said top collar member and said bottom end member, an intermediate sub-assembly including a partitioning member, an intermediate base member and a plurality of stays interconnecting said partitioning member and said intermediate base member, said top collar member includes a border portion defining an aperture for receiving golf clubs, said partitioning member includes a substantially rigid grid structure for dividing said aperture into a plurality of sections, said partitioning member includes fastening means for engagement with corresponding fastening means on said top collar member, at least a substantial portion of said intermediate sub-assembly is surrounded by said flexible body with said intermediate member disposed adjacent to said bottom end member when said partitioning means is engaged with said top collar member.

According to a third aspect of the present invention, there is provided a golf bag including a first sub-assembly and a second sub-assembly, said first sub-assembly includes a top collar member, a bottom member and a flexible body interconnecting said top collar member and said bottom member; said second sub-assembly includes a partitioning member, an intermediate base member and a plurality of stays interconnecting said partitioning member and said intermediate base member, said top collar member includes a border portion defining an aperture for receiving golf clubs, said partitioning member includes a substantially rigid grid structure for dividing said aperture into a plurality of sections, said partitioning member includes fastening means for corresponding engagement with fastening means on said top collar member, said second sub-assembly is substantially received by said first sub-assembly with at least a substantial length of said stays of said second sub-assembly being surrounded by said flexible body when said partitioning member is engaged with said top collar member of said first sub-assembly.

According to a fourth aspect of the present invention, there is provided a method of assembling a golf bag from a semi-knocked down kit including an outer sub-assembly, an inner sub-assembly and a plurality of stays, said outer sub-assembly includes a top collar member, a bottom end member and a flexible body interconnecting said top collar member and said bottom end member, said inner sub-assembly includes a partitioning member, an intermediate base member and a plurality of flexible partitioning straps interconnecting said partitioning member and said intermediate base member, said partitioning member and said intermediate base member include corresponding fastening means for engaging said plurality of stays in a substantially parallel manner, said method including:

connecting said stays to said inner sub-assembly so that said partitioning member and said intermediate base member are interconnected by said stays, inserting said intermediate member into said flexible body and towards said bottom member, fastening said partitioning member with said moulded to collar member, said first sub-assembly and said second sub-assembly being connected by fastening engagement between said partitioning member of said second sub-assembly and said top collar member of said first sub-assembly, said intermediate base member of said second sub-assembly being disposed adjacent to said bottom member of said first sub-assembly.

According to yet another aspect of the present invention, there is provided a semi-knocked down kit of a golf bag including an outer sub-assembly, an inner sub-assembly and a plurality of stays, said outer sub-assembly includes a top collar member, a bottom end member and a flexible body interconnecting said top collar member and said bottom end member, said inner sub-assembly includes a partitioning member, an intermediate base member and a plurality of flexible partitioning straps interconnecting said partitioning member and said intermediate base member, said partitioning member and said intermediate base member include corresponding fastening means for engaging said plurality of stays in a substantially parallel manner.

According to yet another aspect for the present invention, there is provided a semi-knocked down kit of a golf bag including an outer sub-assembly, a partitioning member and a plurality of stays, said outer sub-assembly includes a top collar member, a bottom end member and a flexible body interconnecting said top collar member and said bottom end member, said partitioning member includes a substantially rigid grid structure for dividing said aperture into a plurality of sections, said partitioning member includes fastening means for engagement with corresponding fastening means on said top collar member, said partitioning member and said bottom end member include corresponding fastening means for engaging said plurality of stays in a substantially parallel manner.

Broadly speaking, the present invention has provided a top end member of a golf bag including a partitioning member and a top rim member, said partitioning member includes a partitioning grid structure and retention means for receiving one end of the stays of a golf bag, said partitioning member and said top rim member being formed with corresponding engagement means.

Probably, delimiting means are provided on said top rim member immediately adjacent to said engagement means.

BRIEF DESCRIPTION OF THE DRAWINGS

Preferred embodiments of the present invention will be explained by way of examples and with reference to the accompanying drawings, in which.

DETAILED DESCRIPTION OF THE PRESENT INVENTION

Some of the basic building parts or components that can be utilized to build golf bags embodying the preferred embodiments of the present invention are shown in FIGS. 1–6.

Figure 1A:
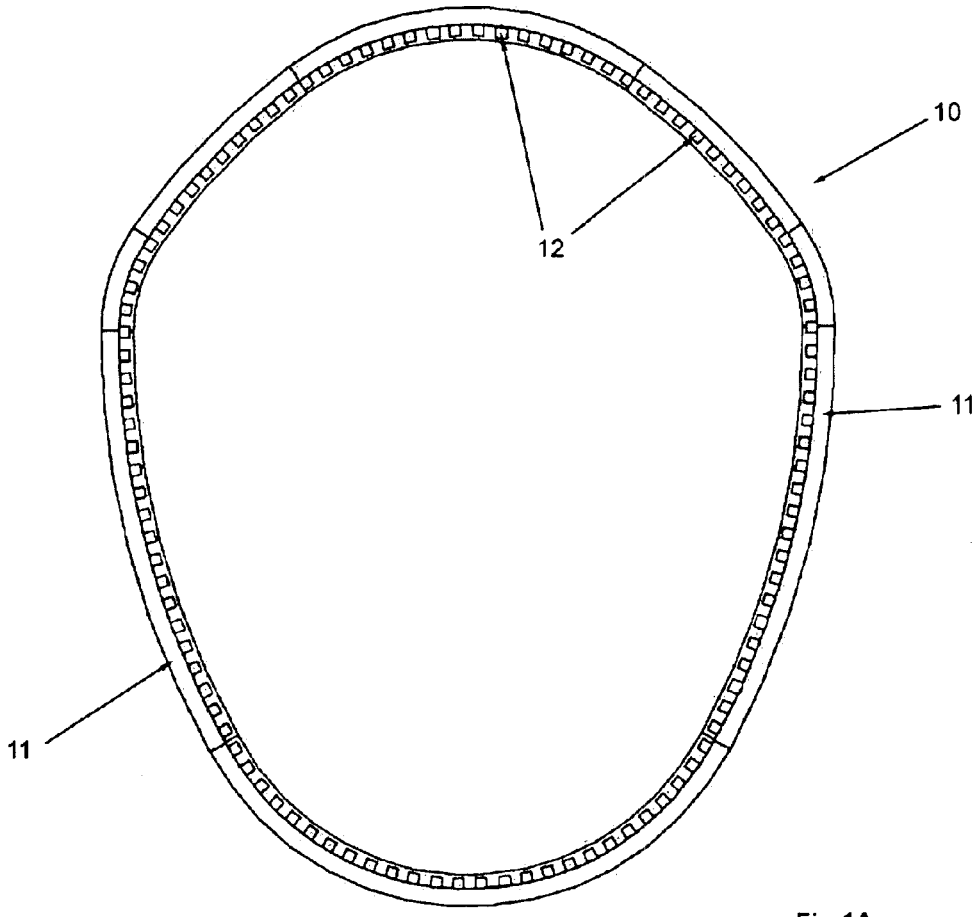
FIG. 1A shows a top plan view of a first preferred embodiment of a top collar member for the preferred embodiments of the present invention.

FIG. 1A shows a first preferred embodiment of a top collar member 10 for connection to the upper end of a flexible body 20 of a golf bag. This top collar member 10 is substantially rigid and is preferably moulded from hard plastics and includes a rim 11 or border portion defining the top most aperture of a golf bag for receiving golf clubs. A plurality of fastening or coupling apertures 12 are distributed along the perimeter of this moulded top collar member 10 for connecting to a partitioning member 50 to form the top end member of the golf bag of the present invention. Detailed construction and utilization of the top collar member 10 and the partitioning member 50 to be explained below.

Figure 1B:
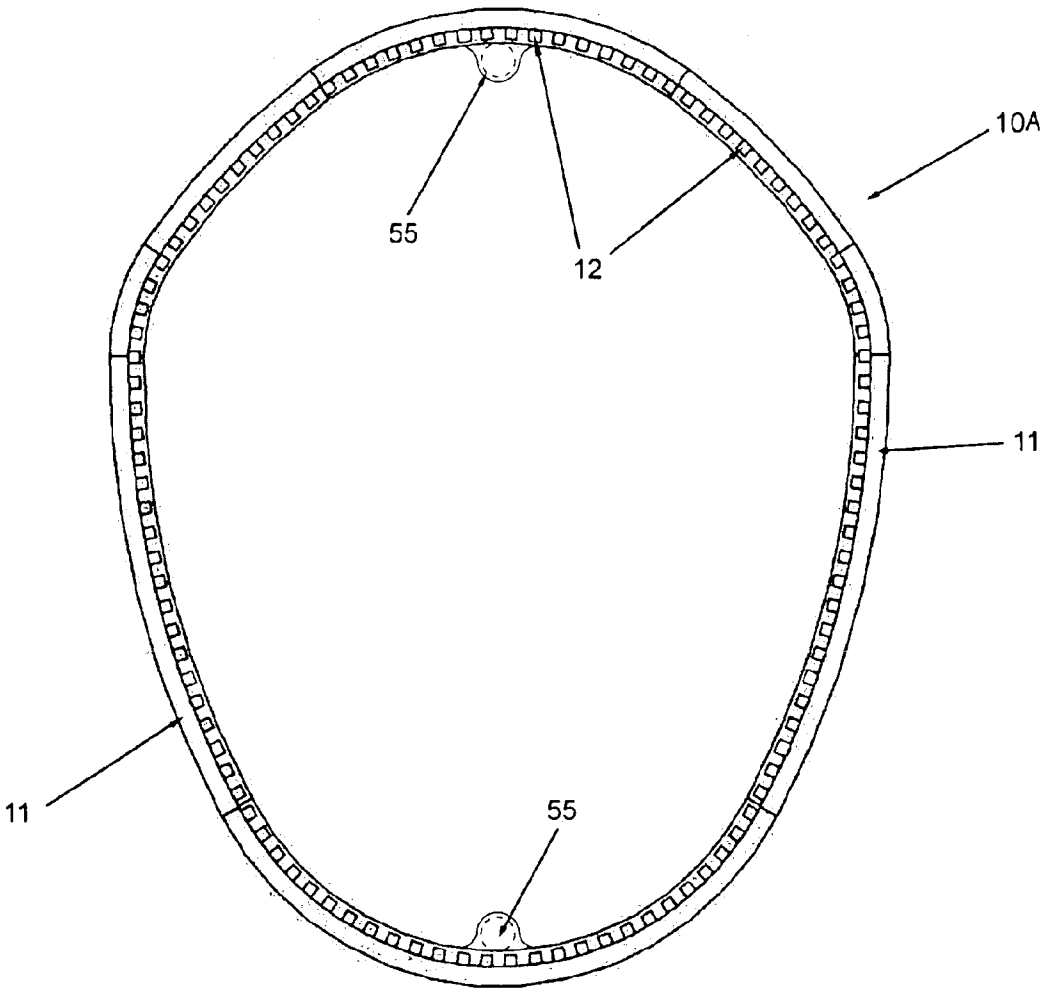
FIG. 1B shows a top plan view of a second preferred embodiment of a top collar member for the preferred embodiments of the present invention.

A second preferred embodiment of the top collar member 10A shown in FIG. 1B includes a plurality of a stay receiving means disposed at positions corresponding to the stay receiving means on the bottom end member so that the stays interconnecting the top end member and the bottom end member of the golf bag are substantially parallel to the longitudinal axis of the body of the golf back. The stay receiving means on the top collar member 10 are preferably integrally moulded with the top collar member 10 for increased strength and simplicity in assembling. The stay receiving means can be, for example, channels extending towards the bottom end member so that the top end of the stays can be inserted into them by upward longitudinal stretching of the flexible body of the golf bag. Alternatively, the stay receiving channels may be provided with a longitudinal aperture dimensioned to be suitable for secured lateral snap-fitting with the top end of a stay.

Figure 2:
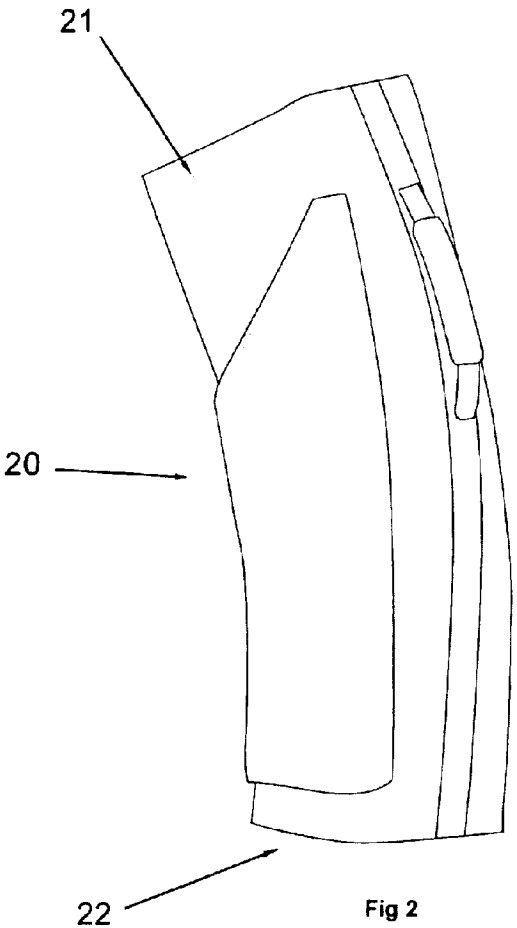
FIG. 2 shows an example of a flexible body suitable for the preferred embodiments of the present invention.
Figure 5A:
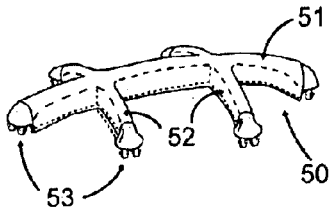
FIG. 5A illustrates an example of a preferred partitioning member.
Figure 5B:
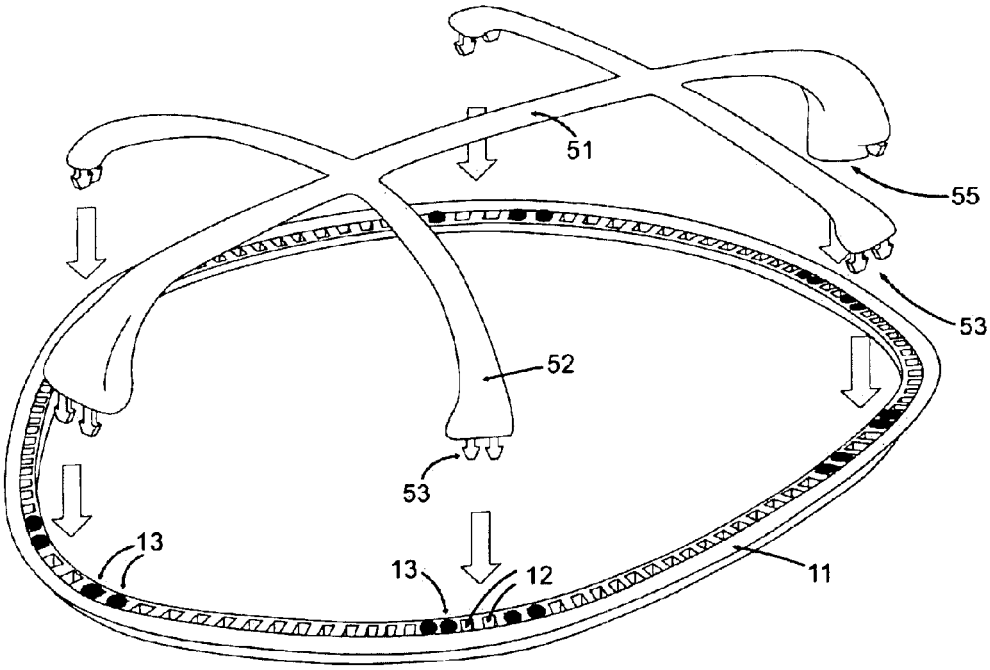
FIG. 5B illustrates the attaching of the partitioning member of FIG. 5A to the top collar member.
Figure 5C:
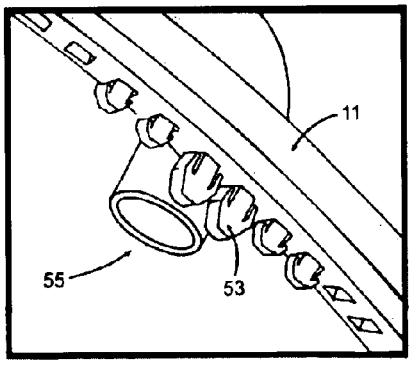
FIG. 5C shows an enlarged view from the underside of the top collar member illustrating the connection between the partitioning member and the top collar member.
Figure 5D:
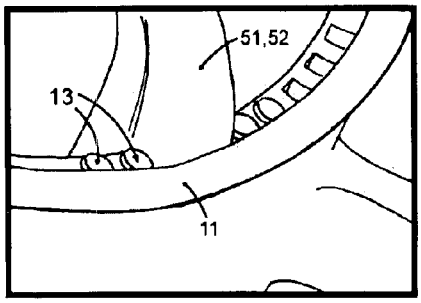
FIG. 5D shows the connection of FIG. 5C from above the top collar member.
Figure 5E:
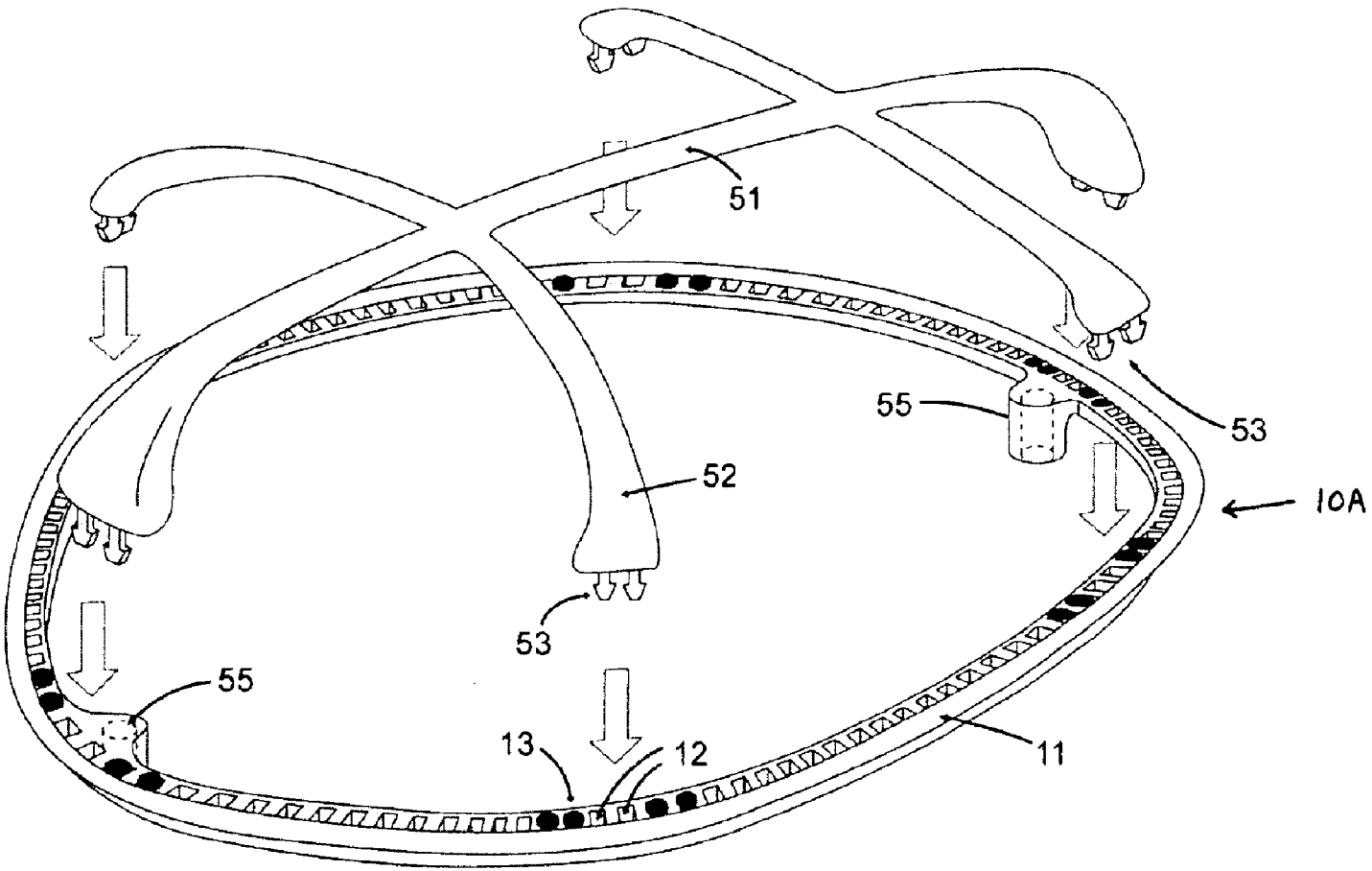
FIG. 5E illustrates the attaching of a second preferred embodiment of the partitioning member to the top collar member of FIG. 1B.

FIG. 2 shows an elongated flexible body which can be made of, for example, fabrics, leather, nylon, polyester or other suitable flexible materials. The flexible body 20 is a generally hollow cylindrical body with an upper aperture 21, a lower aperture 22 and a flexible enclosure extending in a generally longitudinal direction and surrounding the upper and lower apertures.

Figure 3B:
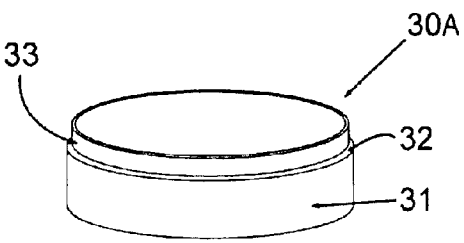
FIG. 3B shows an example of a suitable moulded bottom member for a second preferred embodiment of the present invention.
Figure 3A:
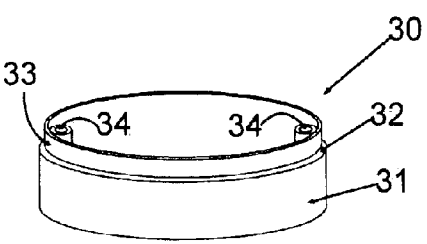
FIG. 3A shows an example of a suitable moulded bottom member for a first preferred embodiment of the present invention.

FIG. 3A shows a bottom end member 30 for attaching to the lower end of the cylindrical flexible body and for closing off the bottom aperture of the flexible body 20. The bottom end member 30 generally includes a closed bottom part with an upstanding peripheral wall surrounding the closed bottom. The upstanding peripheral wall 31 includes a stepped circumferential portion defining a flange 32 from which a further secondary upstanding circumferential wall 33 extends.

Usually, the bottom end member 30 is attached to the lower end of the flexible body by connecting the secondary peripheral wall, for example, through sewing or other appropriate fastening means. Upon connection, the lower end of the flexible body will rest on the stepped flange portion 32 with a smooth transition and continuity between the lower end of the flexible body to the upper edge of the primary circumferential peripheral wall 31 of the bottom end member 30. This bottom end member 30 is preferably moulded from a strong and hard plastic material as it has to bear the weight to the golf clubs.

A plurality of retention means 34 are formed on the upper surface of the bottom part of this bottom end member 30. The retention means 34 is formed in the form of an upstanding channel extending along the longitudinal direction of the flexible body 20 so that the stays can be received in a substantially upright orientation. The stay receiving channels are preferably dimensioned so that it receives one end of a stay member in a close-fitting manner with sufficient stability. For example, the stay receiving channels 34 can be formed with internal screw threads while the corresponding end of the stays can be formed with appropriately dimensioned external screw threads for screw engagement so that the stays are securely supported and extending generally in the longitudinal orientation.

Figure 4:
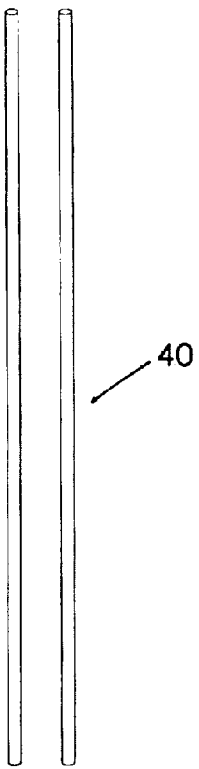
FIG. 4 shows an example of stays for the preferred embodiments of the present invention.

Examples of suitable stays 40 are shown in FIG. 4. The stays 40 are preferably made of a rigid and strong material such as hard plastics or a light metal alloy such as aluminium alloys. The stays in the present preferred embodiments have non-threaded ends for easy insertion. To provide more secure stays retention, screw threads may be provided at both ends of the stays for screw-threaded engagement with the corresponding fastening means. For example, the screw-threads at the ends of the stays may be threaded so that the partitioning member 50 and the bottom end member 30 are drawn together while the stays 40 are being tightened.

FIG. 5 shows an example of a preferred partitioning member 50 for use in the present embodiment. This partitioning member 50 includes a plurality of interconnected rib-shaped members defining a grid forming a plurality of partitioning sections or compartments for receiving golf clubs. The present partitioning member 50 includes a longitudinal rib-shaped member 51 connected with a plurality of transversally rib-shaped members 52 which are distributed along the length of the longitudinal rib member 51 and forming a plurality of cross junctions. Of course, the partitioning member 50 can be formed with partitioning grids including grids of various shapes and configurations as desired and appropriate. Fastening or engagement means are formed at the ends of the rib-shaped members. The fastening means shown in the present preferred embodiment includes a pair of resilient legs with an inverted hook disposed near the end of each leg.

Retention means 55, which are in the form of downwardly extending stays receiving channels, are formed on the under side of the partitioning means for secure and taut retention of the stays when the partitioning member 50 has been fastened to the top collar member 10 to form the top end member of the golf bag.

It will be appreciated that the fastening or coupling apertures 12 or fastening means distributed on the top collar member 10 allow enhanced flexibility for fastening engagement so that partitioning members having different disposition or distribution of fastening means can be matched and fastened to the top collar member 10 to form a top end member of the golf bag. This design allows partitioning members having different grid layouts and/or with different fastening means disposition to be mixed and matched with the top collar member 10. Thus, a user possessing a plurality of partitioning members compatible to a specific top collar member can select a preferred or desirable partitioning member to form a golf bag according to his/her preferences or need.

Figure 6C:
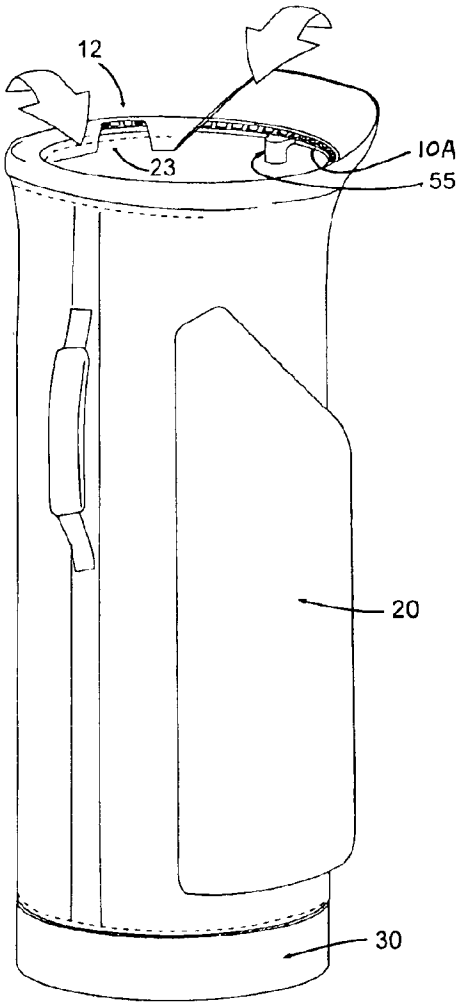
FIG. 6C illustrates the flexible body of FIG. 6A with a moulded top collar member of FIG. 1B attached to its upper end.
Figure 6B:
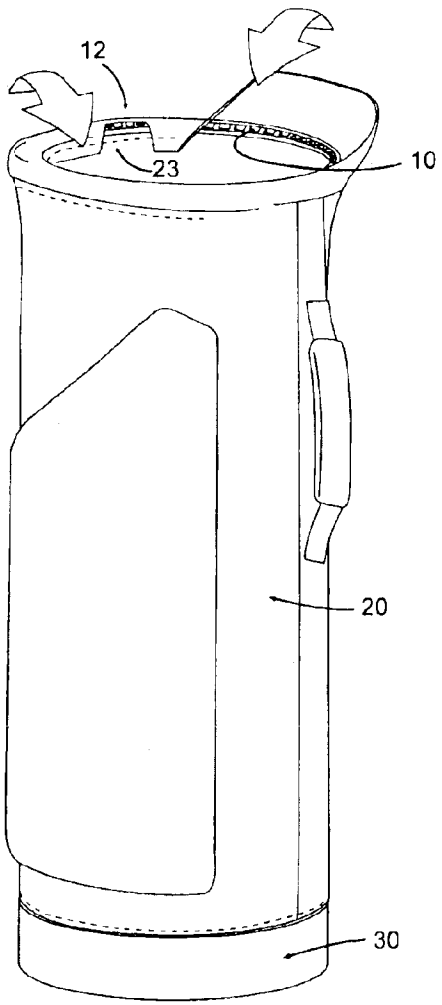
FIG. 6B illustrates the flexible body of FIG. 6A with a moulded top collar member of FIG. 1A attached to its upper end.
Figure 6A:
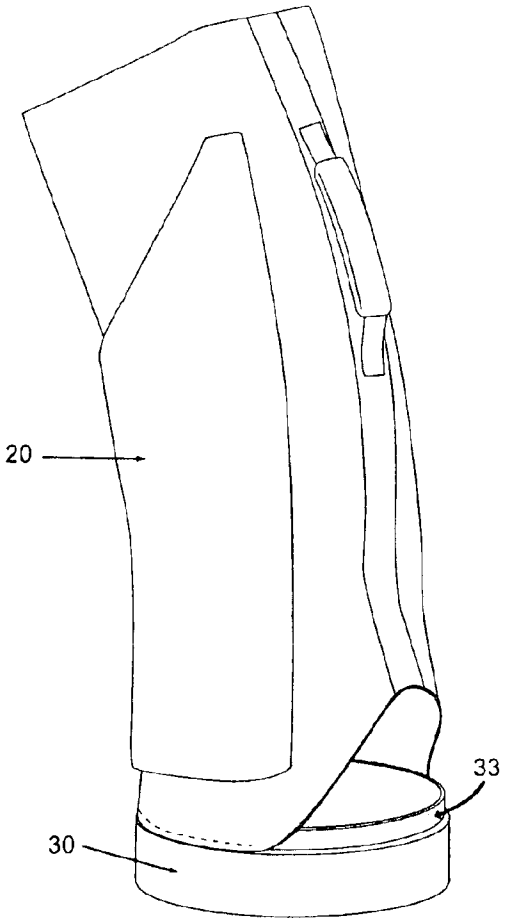
FIG. 6A illustrates the flexible enclosure or body of FIG. 2 with a moulded bottom member attached to its lower end.

Referring now to FIGS. 6A and 6B, a first sub-assembly or an outer-assembly 100 as an intermediate part for forming a golf bag is made by connecting the upper end of the bottom end member 30 to the lower end of the flexible body 20. This can be made, for example, by sewing or fastening the lower end of the flexible body 20 to the secondary peripheral wall 33 which extends upwardly from the stepped circumferential flange 32. The top collar member 10 is attached to the upper end of the flexible body 20 by, for example, wrapping a portion of the upper end of the flexible body 20 around the border or rim portion and then by fastening or retaining the top collar member 10 through sewing or other fastening means. Appropriate apertures are pre-formed on the upper end of the flexible body 20 so that the fastening apertures provided on the top collar member 10 for fastening with the corresponding fastening means on the partitioning member 50 can be easily located or accessible. With the attachment of the top collar member 10 and bottom end member 30 respectively to the upper and lower ends of the flexible body 20, a first sub-assembly 100 or an outer-assembly of a golf bag is formed.

FIG. 6C shows a first sub-assembly similar to that of FIG. 6B but using a top collar member 10A of FIG. 1B.

Figure 7A:
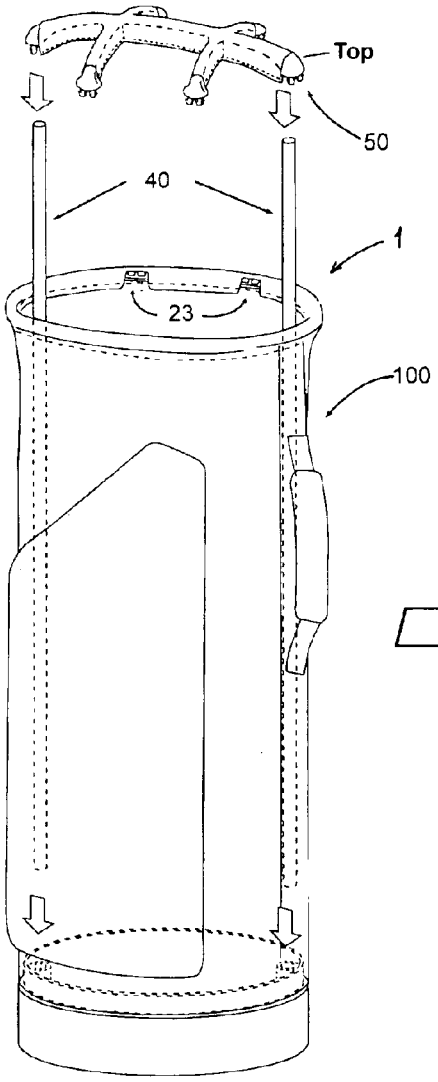
FIG. 7A illustrates the forming of a first preferred embodiment of a golf bag of this invention by attaching a partitioning member and stays to the sub-assembly of FIG. 6B.
Figure 7B:
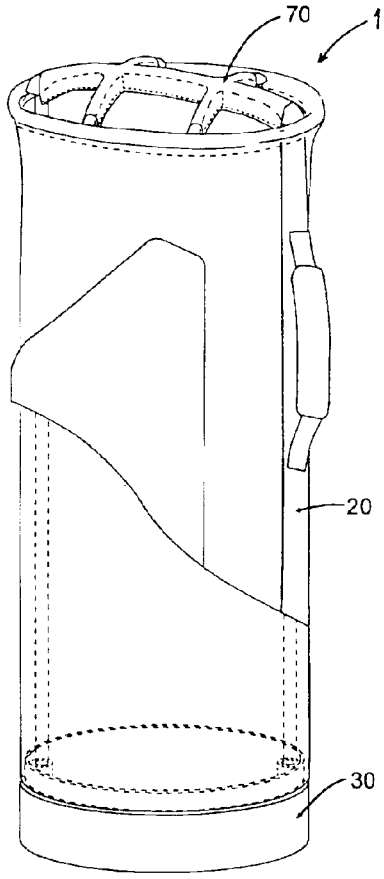
FIG. 7B illustrates in partly exposed form the resulting assembly of FIG. 7A.
Figure 10A:
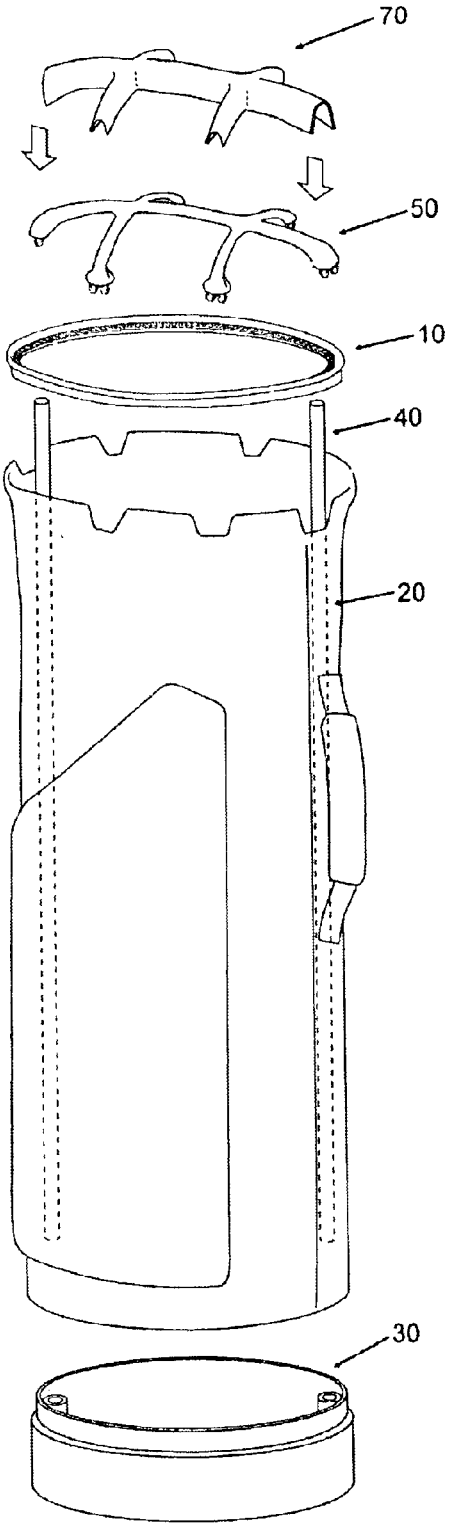
FIG. 10A illustrates in exploded form the golf bag of a first preferred embodiment of the present invention.

Referring to FIGS. 7A, 7B and 10A, there is shown a first preferred embodiment of a golf bag 1 of the present invention. It will be noted that the bottom end member 30 of this golf bag includes a moulded bottom end member as shown in FIG. 3A which includes a plurality of stay retention means 34 on the bottom end member 30. To assemble this golf bag, the stays 40 are inserted into the stay receiving means 34 on the bottom end member 30, which are upwardly extending stay receiving channels in the present example. The other ends of the stays 40 are coupled to the stay retention means 55 disposed correspondingly on the underside of the partitioning member 50. The stay retention means 34, 55 on both the partitioning member 50 and the bottom end member 30 are preferably dimensioned so that the stays are properly secured when the partitioning member 50 are secured onto the fastening apertures 12 disposed along the rim 11 of the top collar member 10. The stay retention means 34, 55 in the present embodiment are longitudinally extending channels with a sufficient depth so that the stays 40 can be securely retained by the channels in a substantially upright direction. As such, the stays are generally parallel to the longitudinal direction of the elongated golf bag when assembled.

It will be noted that the pre-cuttings or the pre-formed apertures 23 on the upper end of the flexible enclosure 20 will expose the necessary corresponding fastening apertures 12 on the top collar member 10 for corresponding engagement with the fastening means formed at the end of the rib-shaped members 51, 52. The provision of the pre-cut portions 23 on the flexible body 20 allows easy alignment and access of the fastening apertures and therefore facilitates easy and accurate assembling. The partitioning members 50 can be securely attached and held on the top collar member 10 by the inverted hooks at the end of the bifurcated legs and this attachment helps to pull and maintain taut the flexible body 20. It will be appreciated that the flexible body 20 generally surrounds a substantial portion of the length of the stays when assembled.

To facilitate easy alignment of the pre-formed apertures 23 with the fastening apertures 12 on the top collar member 10, delimiting means 13 are provided on the top collar member. The delimiting means utilized in the present preferred embodiments are studs or bolts 13 which occupy the apertures of the top collar member immediately adjacent to the fastening apertures. These delimiting studs or bolts 23 are disposed corresponding to the locations of pre-cut apertures 23 and the fastening means 53.

When a golfer or a golf bag user wishes to transport a golf bag in a less bulky manner, the golf bag can be disassembled by detaching the stays from the partitioning member or the top end member of the complete golf bag. This will substantially reduce the volume of the golf bag for transportation. Of course, the golf bag can be easily re-assembled as and when desired.

Figure 7C:
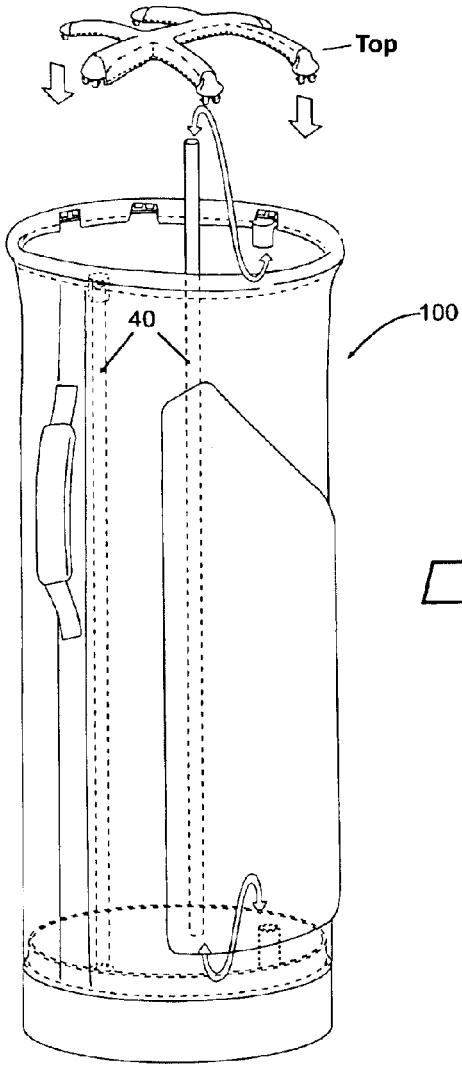
FIG. 7C illustrates the forming of a first preferred embodiment of a golf bag of this invention by attaching a partitioning member of FIG. 5E and stays to the sub-assembly of FIG. 6C.
Figure 7D:
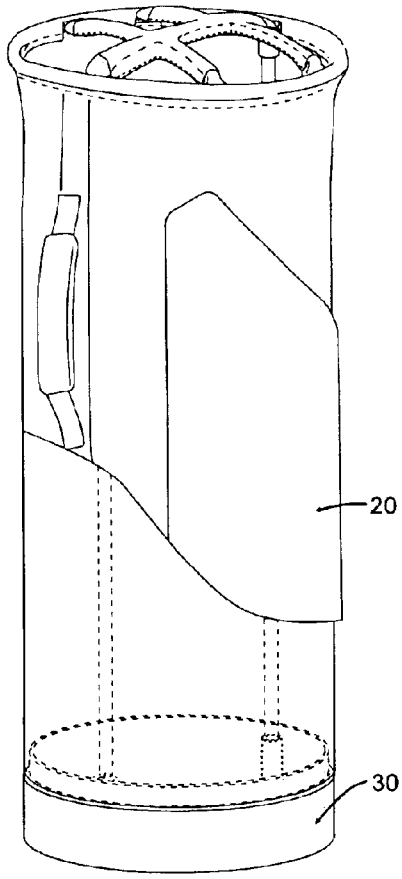
FIG. 7D illustrates in partly exposed from the resulting assembly of FIG. 7C.
Figure 8A:
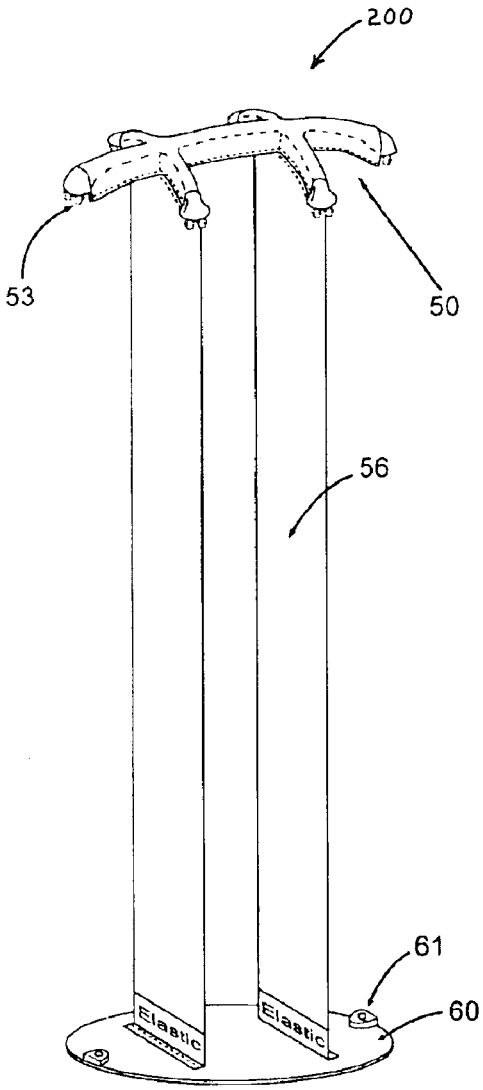
FIG. 8A shows a semi-sub-assembly with the partitioning member of FIG. 5A connected to an intermediate base member via a plurality of flexible straps.
Figure 8B:
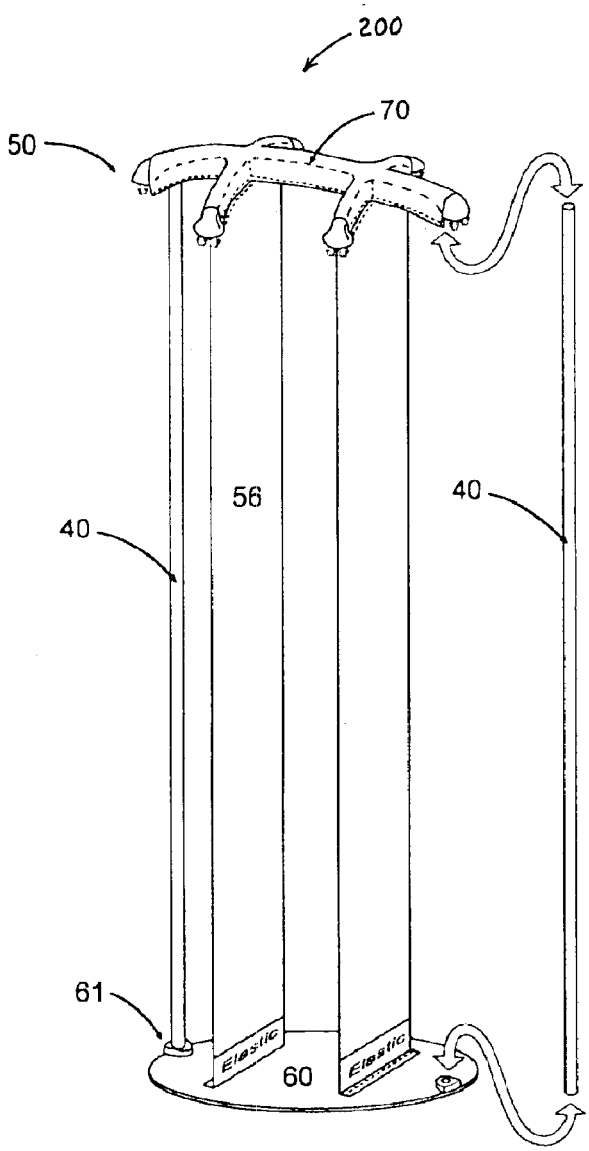
FIG. 8B illustrates the attachment of substantially rigid stay members to the semi-sub-assembly of FIG. 8A to form a sub-assembly.
Figure 9A:
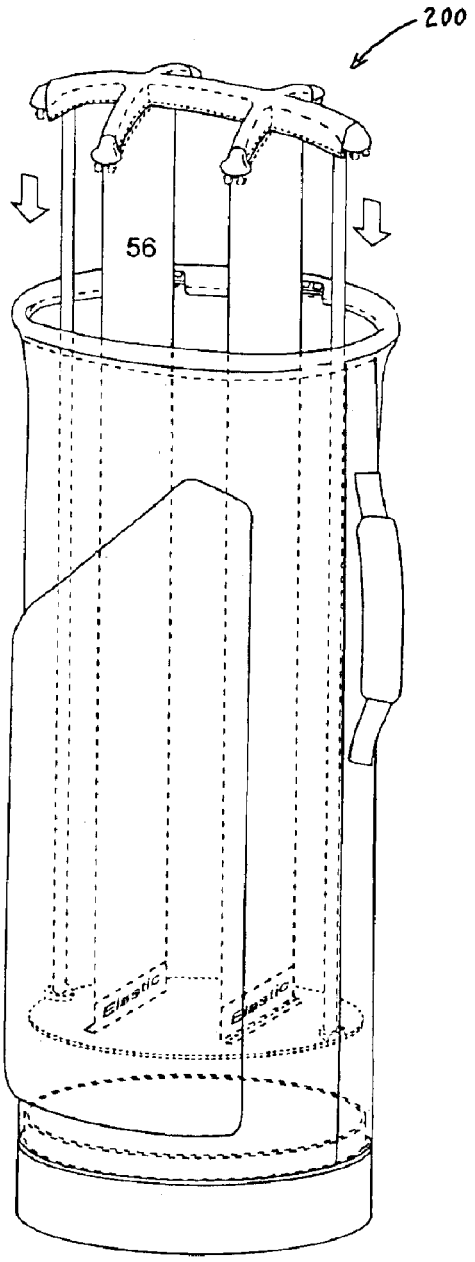
FIG. 9A illustrates the insertion of the sub-assembly of FIG. 8B into the sub-assembly of FIG. 6B.
Figure 9B:
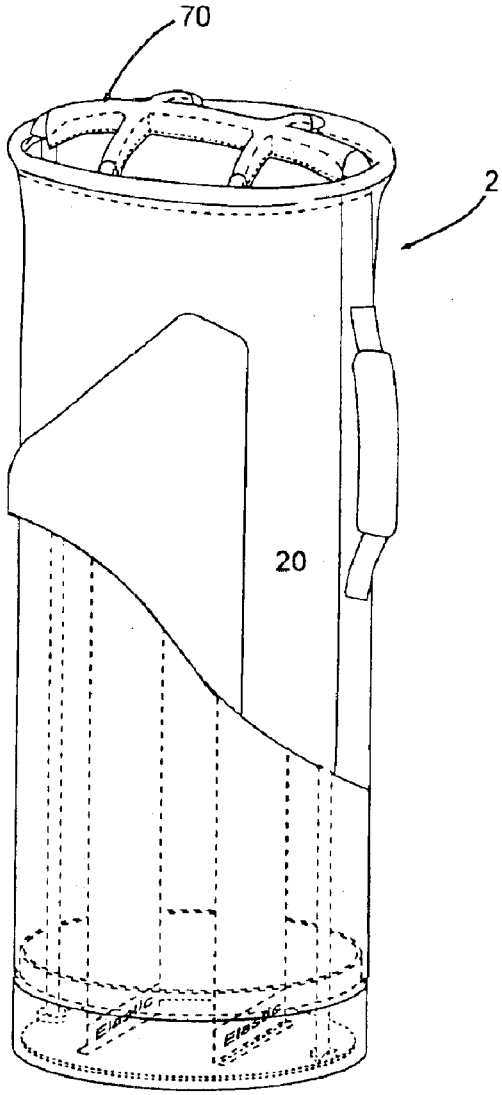
FIG. 9B illustrates in partly exposed form the completed assembly of FIG. 9A.

FIGS. 7C and 7D show another example of a first preferred embodiment of a golf bag of the present invention, although a second preferred embodiment of a top collar member of FIG. 1B is used in this example.

Figure 10B:
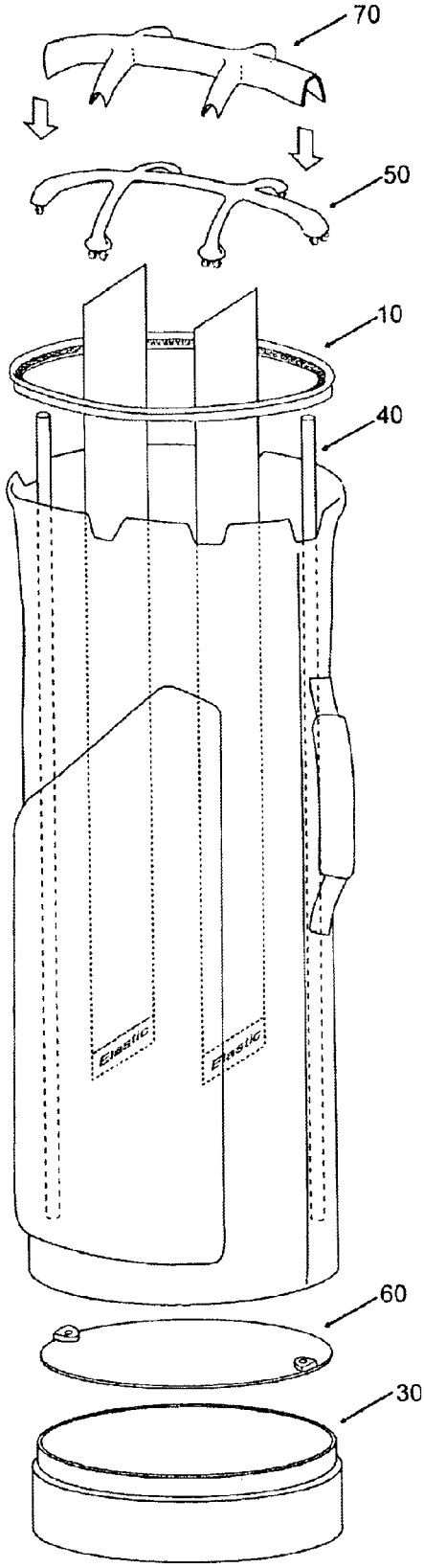
FIG. 10B illustrates in exploded form a second preferred embodiment of a golf bag of the present invention.

A second preferred embodiment of the golf bag 2 of the present invention is shown in FIG. 10B with the various parts for constructing or making of this embodiment shown in FIGS. 8A to 9B. In general, a golf bag of this second preferred embodiment includes a first or outer sub-assembly 100 of FIG. 6A and a second or inner sub-assembly 200. The second or inner sub-assembly 200 includes a partitioning member 50, an intermediate base member and stays 40 connecting them. The intermediate base member 60 is a rigid member, for example, a plate-shaped member, dimensioned to be received on the upper part of the bottom end member 30A. The partitioning member 50 and the intermediate base member 60 are interconnected with flexible straps 56 for forming the various compartments for golf clubs storage. The flexible straps 56 are preferably made of a flexible and yet robust material such as nylon or polyester. The length of the flexible straps are preferably calculated so that the flexible straps are substantially taut when the stays 40 are connected and held between the partitioning member 50 and the intermediate base member 60. The straps may be fastened to the partitioning member 50 and the intermediate base member 60 by sewing or by means of detachable fastening means such as Velcro®.

Stay retention means 61 are also formed on the upper surface of the intermediate base member 60 and the retention means 61 are disposed in an aligned member so that corresponding stay receiving means on the partitioning member 50 are directly above that on the intermediate base member 60. The semi-sub-assembly (comprising the partitioning member 50, straps 56 and the intermediate base member 60) is then connected with stays so that an inner-sub-assembly with a generally robust and rigid structure supported by the stays 40 are formed. This inner-sub-assembly is then inserted into the first sub-assembly 100 of FIG. 6A with the under-surface of the intermediate base member 60 inserted inside the flexible body 20 and towards the upper surface of the bottom end member 30A.

The length of the stays are preferably designed so that when the intermediate base member 60 is resting on the upper surface of the bottom end member 30, the fastening means on the partitioning members will at that time securely fasten onto the fastening apertures of the top collar member 10. Hence, by the insertion of this inner sub-assembly 200 into the outer sub-assembly 100, a golf bag has been assembled. It will be appreciated that this design allows the assembling of a generally robust golf bags in an easy way without the need of any specific tools so that golfers or golf bag users can assemble or reassemble the golf bags as and when desired or necessary.

Figure 11B:
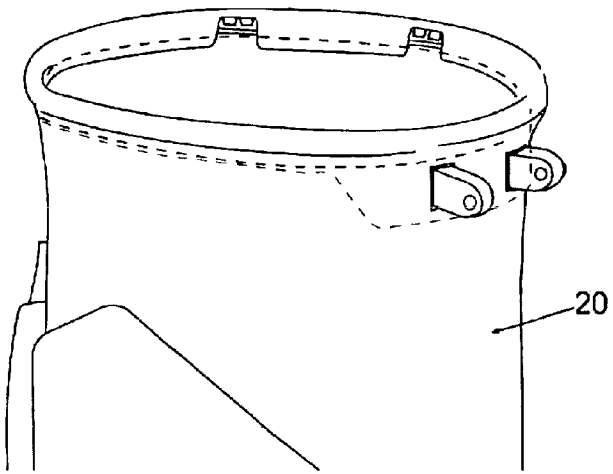
FIG. 11B illustrates the parts of FIG. 11A when assembled.
Figure 11A:
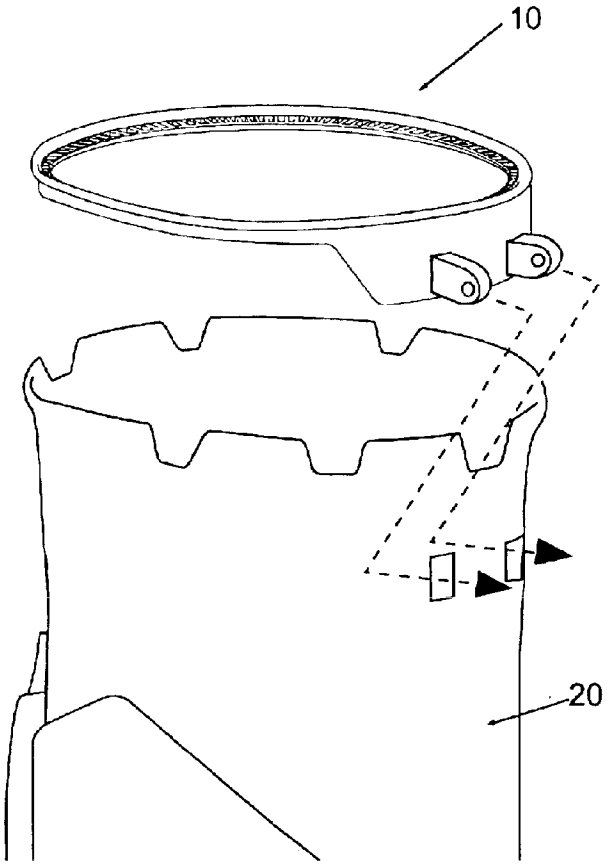
FIG. 11A illustrates an alternative form of a top collar member with a corresponding flexible enclosure body.
Figure 12A:
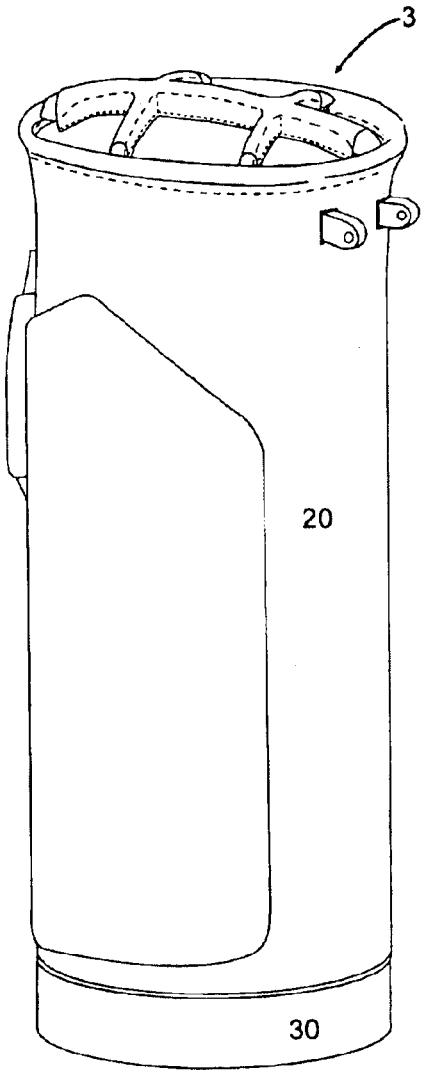
FIG. 12A illustrates the parts of FIG. 11B assembled with the partitioning member.
Figure 12B:
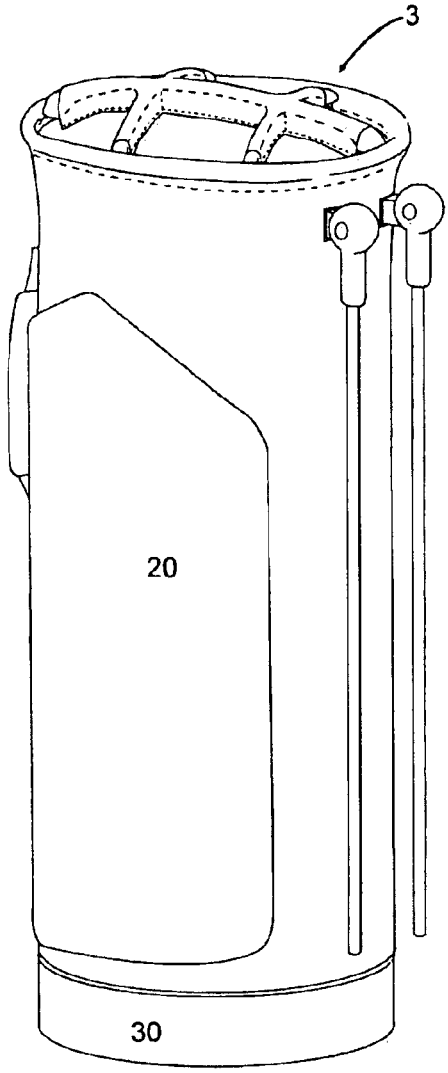
FIG. 12B illustrates the parts of FIG. 12A assembled with a pair of pivotal legs.

Referring to FIGS. 11A, 11B, 12A and 12B, there is shown the assembling of a golf bag 3 with a pair of pivotal legs embodying the present invention. It will be appreciated that by suitable modification of the top collar member by including a pair of attachment means or brackets for receiving a pair of pivotal legs, a pair of pivotal stands for supporting the golf bag in a generally right position can be easily assembled and dis-assembled. Referring to FIG. 11A, it will be appreciated that the attachment means are preferably moulded on a peripheral wall extending generally longitudinally along part of the circumference of the top collar member. The attachment means generally extend in a radial manner and protrude beyond the flexible enclosure 20. To provide outlets for the pair of attachment means to be exposed, corresponding apertures are formed on the flexible body as shown in FIGS. 11A and 11B.

Furthermore, to protect the shaft of golf clubs, a cushioning material 70 is preferably wrapped around the rib-shaped members as shown in FIGS. 11A and 11B.

While the present invention has been explained by reference to the preferred embodiments described above, it will be appreciated that the embodiments are only examples provided to illustrate the present invention and are not meant to be restrictive on the scope and spirit of the present invention. This invention should be determined from the general principles and spirit of the invention as described above. In particular, variations or modifications which are obvious or trivial to persons skilled in the art, as well as improvements made on the basis of the present invention, should be considered as falling within the scope and boundary of the present invention. Furthermore, while the present invention has been explained by reference to certain basic parts, it should be appreciated that the invention can apply, whether with or without modification, to golf bags apart from all or a selection only of the parts described with loss of generality.

| Reference Number List | |
|---|---|
| 1 | golf bag of 1st embodiment |
| 2 | golf bag of 2nd embodiment |
| 3 | golf bag with a stand |
| 10 | top collar member |
| 11 | rim |
| 12 | fastening apertures |
| 13 | delimiting means for fastening aperture |
| 20 | flexible body |
| 21 | upper aperture |
| 23 | pre-cut aperture for exposing fastening apertures 22 |
| 22 | lower aperture |
| 30 | bottom end member |
| 31 | primary peripheral wall |
| 32 | flange |
| 33 | secondary peripheral wall |
| 34 | stay receiving channel |
| 40 | stay |
| 50 | partitioning member |
| 51 | longitudinal rib |
| 52 | transversal rib |
| 53 | fastening means |
| 55 | stay receiving channel |
| 56 | flexible partitioning straps |
| 60 | intermediate base member |
| 61 | stay retention means |
| 70 | cushioning on partitioning member |
| 100 | outer sub-assembly |
| 200 | inner sub-assembly |

What is claimed is:

1. A golf bag comprising an outer sub-assembly and an intermediate sub-assembly which are snap-fitted together to form a complete golf-bag, said outer sub-assembly comprising a top collar member, a bottom end member, a flexible body interconnecting said top collar member and said bottom end member, said top collar member including a border portion defining a golf-club receiving aperture, said intermediate sub-assembly comprising a partitioning member, an intermediate base member and a plurality of stays supporting said partitioning member on said intermediate base member; said partitioning member including a substantially rigid grid structure for dividing said golf-club receiving aperture into a plurality of golf club receiving sections, said intermediate base member being insertable into said outer sub-assembly, said partitioning member and said top collar member comprising cooperative snap-fitting engagement means wherein, said intermediate sub-assembly is inserted into said outer sub-assembly with said intermediate base member resting on said outer sub-assembly and said partitioning member is in snap-fit engagement with said top collar member, and wherein said flexible body is erected by said partitioning member to form said golf bag.

2. A golf bag according to claim 1, wherein said intermediate base member of said intermediate sub-assembly is supported on said bottom end member of said outer sub-assembly, the flexible body of said outer sub-assembly being supported from collapsing by said partitioning member and stays of said intermediate sub-assembly in combination, said co-operative snap-fitting engagement means being in co-operative snap-fit engagement with said intermediate base member resting on the bottom end member of said outer sub-assembly, whereby said flexible body is erected by said stays via said partitioning member to form said golf bag.

3. A golf bag according to claim 2, wherein said flexible body of said outer sub-assembly is supported from collapsing by said bottom end member of said outer sub-assembly via said partitioning member.

4. A golf bag according to claim 1, wherein a substantial portion of said intermediate sub-assembly is surrounded by said flexible body, with stays of said intermediate sub-assembly supporting said outer sub-assembly from collapsing.

5. A golf bag according to claim 4, wherein said outer sub-assembly is supported from collapsing by said bottom end member of said outer sub-assembly via stays of said intermediate sub-assembly.

6. A golf bag according to claim 1, wherein said partitioning member of said intermediate member cooperates with said top collar member to define a plurality of golf-club receiving sections.

7. A golf bag according to claim 6, wherein said top collar member includes means adapted for snap-fit engagement with a plurality of alternative partitioning members so that a plurality of alternative configurations of golf-club receiving sections can be formed at said golf-club receiving aperture.

8. A golf bag according to claim 7, wherein said means of said top collar member adapted for snap-fit engagement with a plurality of alternative partitioning members comprises a plurality of apertures adapted for snap-fit engagement with a plurality of alternative partitioning members, and wherein the number of said plurality of apertures for snap-fit engagement with a plurality of alternative partitioning members exceeds the number of snap-fit engagement means on said partitioning means.

9. A golf bag according to claim 8, wherein cooperative snap-fitting engagement means on said partitioning member and said top collar member comprise a pair of fastening means, and said fastening means comprises an aperture and a pair of bifurcated legs which are resiliently movable towards each other when subject to a compressive force towards each other, each said leg having an inverted hook member.

10. A golf bag according to claim 9, wherein said bifurcated legs are formed on said partitioning member and said apertures are formed on said top collar member.

11. A golf bag comprising a top collar member, a bottom end member, a flexible body interconnecting said top collar member and said bottom end member, a partitioning member and a plurality of stays supporting said partitioning member, said top collar member including a border portion defining a golf-club receiving aperture, said partitioning member including a substantially rigid grid structure for dividing said golf-club receiving aperture into a plurality of golf-club receiving sections when assembled with said top collar member, said partitioning member and said top collar member comprising cooperative snap-fitting engagement means so that when a sub-assembly of said partitioning member and said plurality of stays is inserted into said flexible body and, after the cooperative engagement means in said partitioning member and said top collar member are snap-fitted together, wherein said flexible body is supported from collapse by said bottom end member via said stays and said snap-fitted partitioning member.

12. A golf bag kit comprising an outer sub-assembly and an intermediate sub-assembly which are snap-fitted together to form a complete golf-bag, said outer sub-assembly comprising a top collar member, a bottom end member, a flexible body interconnecting said top collar member and said bottom end member, said top collar member including a border portion defining a golf-club receiving aperture, said intermediate sub-assembly comprising a partitioning member, an intermediate base member and a plurality of stays supporting said partitioning member on said intermediate base member; said partitioning member including a substantially rigid grid structure for dividing said golf-club receiving aperture into a plurality of golf-club receiving sections, said intermediate base member being insertable into said outer sub-assembly, said partitioning member and said top collar member comprising cooperative snap-fitting engagement means wherein, when said intermediate sub-assembly is inserted into said outer sub-assembly with said intermediate base member resting on said outer sub-assembly and after said partitioning member has entered into snap-fit engagement with said top collar member, said flexible body is erected by said stays via said partitioning member to form said golf bag.

13. A golf bag according to claim 12, wherein said intermediate base member of said intermediate sub-assembly is supported on said bottom end member of said outer sub-assembly, the flexible body of said outer sub-assembly being supported from collapsing said partitioning member and by stays of said intermediate sub-assembly in combination, said co-operative snap-fitting engagement means being in co-operative snap-fit engagement with said intermediate base member resting on the bottom end member of said outer sub-assembly, whereby said flexible body is erected by said stays via said partitioning member to form said golf bag.

14. A golf bag according to claim 13, wherein said flexible body of said outer sub-assembly is supported from collapsing by said bottom end member of said outer sub-assembly via stays of said intermediate sub-assembly.

15. A golf bag according to claim 13, wherein said flexible body of said outer sub-assembly is supported from collapsing by said bottom end member of said outer sub-assembly via said partitioning member.

16. A golf bag according to claim 12, wherein a substantial portion of said intermediate sub-assembly is surrounded by said flexible body, with stays of said intermediate sub-assembly supporting said outer sub-assembly from collapsing.

17. A golf bag according to claim 16, wherein said outer sub-assembly is supported from collapsing by said bottom end member of said outer sub-assembly via stays of said intermediate sub-assembly.

18. A golf bag according to claim 12, wherein said partitioning member of said intermediate member cooperates with said top collar member to define a plurality of golf-club receiving sections.

19. A golf bag according to claim 18, wherein said top collar member includes means adapted for snap-fit engagement with a plurality of alternative partitioning members so that a plurality of alternative configurations of golf-club receiving sections can be formed at said golf-club receiving aperture.

20. A golf bag according to claim 19, wherein said means of said top collar member adapted for snap-fit engagement with a plurality of alternative partitioning members comprises a plurality of apertures adapted for snap-fit engagement with a plurality of alternative partitioning members, and wherein the number of said plurality of apertures for snap-fit engagement with a plurality of alternative partitioning members exceeds the number of snap-fit engagement means on said partitioning means.

21. A golf bag according to claim 20, wherein cooperative snap-fitting engagement means on said partitioning member and said top collar member comprise a pair of fastening means, and said fastening means comprises an aperture and a pair of bifurcated legs which are resiliently movable towards each other when subject to a compressive force towards each other, each said leg having an inverted hook member.

22. A golf bag according to claim 21, wherein said bifurcated legs are formed on said partitioning member and said apertures are formed on said top collar member.

* * * * *